US005984298A

United States Patent [19]

Wada et al.

[11] Patent Number: 5,984,298

[45] Date of Patent: Nov. 16, 1999

[54] SHEET FEEDING APPARATUS WITH A DRIVING DEVICE FOR A PAPER STOPPER

[75] Inventors: Hiroshi Wada; Mitsuharu Yoshimoto; Sinji Yamamoto; Junichi Inada; Susumu Hanano; Takeshi Sakaguchi; Eijiro Masaki; Susumu Takehara; Tadahiro Kiyosumi, all of Osaka, Japan

[73] Assignee: Mita Industrial Co., Ltd., Osaka, Japan

[21] Appl. No.: 08/967,983

[22] Filed: Nov. 12, 1997

[30] Foreign Application Priority Data

Nov. 15, 1996 [JP] Japan ..... 8-304640
Nov. 15, 1996 [JP] Japan ..... 8-304642

[51] Int. Cl.[6] ..... B65H 3/56

[52] U.S. Cl. ..... 271/121; 271/114; 271/115

[58] Field of Search ..... 271/114, 115, 271/116, 121, 122

[56] References Cited

U.S. PATENT DOCUMENTS 4,032,135 6/1977 Ruenzi ..... 271/116
4,822,023 4/1989 Miyoshi ..... 271/122 X
4,925,062 5/1990 Tsukamoto et al. ..... 271/116 X
5,029,839 7/1991 Kajiwara et al. ..... 271/122 X
5,090,675 2/1992 Nagai et al. ..... 271/122 X
5,431,385 7/1995 Holbrook ..... 271/122

FOREIGN PATENT DOCUMENTS

404041341 A 2/1992 Japan .
404159931 A 6/1992 Japan .

*Primary Examiner*—William E. Terrell
*Assistant Examiner*—Patrick Mackey
*Attorney, Agent, or Firm*—Smith, Gambrell & Russell

[57] ABSTRACT

A sheet feeding apparatus having a feeding roller for feeding a sheet, a support shaft forwardly and reversely rotatable integrally with the feeding roller and a stopper disposed upstream of the feeding roller in the sheet feeding direction for temporarily regulating the feed of a sheet to the feeding roller. When the rotation in one direction of the feeding roller is transmitted to a locking member through a one-way clutch, the locking member is rotated to lock the stopper. When the feeding roller is rotated in the opposite direction, the locked state of the stopper is released.

9 Claims, 5 Drawing Sheets

SHEET FEEDING APPARATUS WITH A DRIVING DEVICE FOR A PAPER STOPPER

BACKGROUND OF THE INVENTION

1. Field of the Invention

The present invention relates to a sheet feeding apparatus to be used in a sheet handling machine such as a copying machine and arranged to feed a document or a paper sheet on which an image is to be transferred.

2. Description of Related Arts

In an image reading apparatus or an image forming apparatus such as a copying machine, a printer, an image reader, a facsimile or the like, there is used a sheet feeding apparatus for automatically feeding a sheet such as a document, recording paper or the like.

FIG. 5 is a section view illustrating the arrangement of a portion of a document feeding apparatus to be used for feeding a document to the document reading unit of a digital electrostatic copying machine. In the vicinity of and on the tip of a document placing unit 31 on which a plurality of documents can be placed in lamination, there is disposed a preliminary feeding roller 32 for taking a document from the document placing unit 31. Downstream of the preliminary feeding roller 32 in the document transfer direction (leftward in FIG. 5), a feeding roller 33 and a separating roller 34 are disposed opposite to each other with a sheet feeding passage 35 interposed therebetween.

The feeding roller 33 has a support shaft 33*a* to which a lever 36 is rotatably attached. The lever 36 has a rocking end to which a support shaft 32*a* of the preliminary feeding roller 32 is rotatably attached. Provision is made such that a rotational force is given to the feeding roller 33 from a drive motor (not shown) and that this rotational force is also transmitted to the preliminary feeding roller 32 through a gear mechanism (not shown).

Provision is made such that the rotation of the support shaft 33*a* of the feeding roller 33 is transmitted to the lever 36 through a one-way clutch. The one-way clutch transmits, to the lever 36, only the rotation of the feeding roller 33 in the anti-sheet feeding direction (counterclockwise in FIG. 5). Accordingly, when the feeding roller 33 is rotated at a predetermined angle in the anti-sheet feeding direction, the lever 36 is rotated counterclockwise, enabling the preliminary feeding roller 32 to be raised. When the preliminary feeding roller 32 is thus raised, a sheet feeding port 37 serving as the inlet of the sheet feeding passage 35 is widely opened, enabling a document D to be readily set.

Disposed between the preliminary feeding roller 32 and the feeding roller 33 is a document stopper 38 for preventing one or more documents D from being inserted to the position of the feeding roller 33 when setting documents D. This document stopper 38 is made of a plate-like body so disposed as to be able to rock around the upper end thereof. A locking mechanism 40 for locking the rocking of the document stopper 38 is disposed in association therewith. This locking mechanism 40 has drive means such as a solenoid or the like for locking the document stopper 38 and for releasing the locked state thereof.

When the solenoid is energized, the document stopper 38 can rock, allowing the document D to be transferred to the feeding roller 33. While the solenoid is not energized, the document stopper 38 is locked by the locking mechanism 40. In such a state, even though a document D is placed on the document placing unit 31 such that the document D is inserted into the position of the sheet feeding port 37, the tip of the document D is regulated by the tip 38*a* of the document stopper 38, preventing the document D from reaching the feeding roller 33.

When setting documents by the user, the preliminary feeding roller 32 is raised and the document stopper 38 is locked. This prevents documents from reaching the feeding roller 33, thus preventing defective separation of documents.

If documents are manually inserted into the sheet feeding passage 35 across the feeding roller 33 and the separating roller 34 and the tips of the documents reach a roller further downstream of the separating roller 34 in the sheet feeding passage 35, the documents can no longer be separated one by one under the action of the separating roller 34. The document stopper 38 prevents the occurrence of such a phenomenon.

When the locked state of the document stopper 38 is released, a document can enter into the sheet feeding passage 35 while the document stopper 38 is rocked by the document.

To intercept the document transfer by the document stopper 38 and to release such an interception, this document feeding apparatus requires, in addition to a drive motor for driving the support shaft 33*a* of the feeding roller 33, locked-state releasing means such as a solenoid or the like for releasing the transfer interception by the document stopper 38. There is further required an electric system for electrical supply to the drive source. This complicates the apparatus in arrangement and increases the number of component elements thereof.

In the document feeding apparatus of the prior art, since the preliminary feeding roller 32 is raised to a predetermined position, a rated electric current is given to the drive motor, causing the same to supply a relatively great torque. However, if an unforeseen accident occurs such that the drive motor does not stop even after the preliminary feeding roller 32 has been raised to the predetermined position, the preliminary feeding roller 32 and the lever 36 are still continuously raised and ultimately come in contact with a cover C of the apparatus. If such a state continues, a great force is continuously exerted to the cover C and the one-way clutch disposed in association with the lever 36. This involves the likelihood that component elements of the apparatus are damaged.

SUMMARY OF THE INVENTION

It is a first object of the present invention to provide a sheet feeding apparatus which can be simplified in arrangement in connection with the drive of a sheet stopper.

It is a second object of the present invention to provide a sheet feeding apparatus capable of preventing the cover or the like of the apparatus from being damaged.

A sheet feeding apparatus according to the present invention comprises: a feeding roller for feeding a sheet; a support shaft forwardly and reversely rotatable integrally with the feeding roller; a stopper disposed upstream of the feeding roller in the sheet feeding direction for temporarily regulating the feed of a sheet to the feeding roller; a locking member for locking the stopper into a regulating position where the feed of a sheet is regulated, and for releasing this locked state; and a one-way clutch attached to the support shaft for transmitting the rotation in one direction of the feeding roller to the locking member, causing the same to lock the stopper.

According to the arrangement above-mentioned, the one-way clutch is arranged not only to lock the stopper but also to release the locked state of the stopper. This eliminates dedicated locked-state releasing means such as a solenoid or the like. This also eliminates the need for an electric system for electrical supply to such a solenoid or the like. This simplifies the sheet feeding apparatus in arrangement and reduces the number of component elements thereof. This results in a reduction in production cost of the apparatus.

Preferably, the one-way clutch is loosened with respect to the support shaft while the feeding roller is rotated in the sheet feeding direction, and transmits the rotation of the support shaft to the locking member while the feeding roller is rotated in the anti-sheet feeding direction.

Provision may be made such that, when the support shaft of the feeding roller is rotated to a first predetermined position in the anti-sheet feeding direction, the locking member is rotated, by the one-way clutch, to a second predetermined position where the locking member comes in contact with the stopper.

The stopper may be so disposed as to be able to rock. In such an arrangement, the locking member is preferably arranged not only to lock the stopper into the regulating position to regulate the rocking of the stopper, but also to release the locked state of the stopper, thus allowing the same to rock.

The one-way clutch may be a spring member wound on the support shaft such that the spring member is loosened with respect to the support shaft while the feeding roller is rotated in the sheet feeding direction, and that the spring member is fastened with respect to the support shaft while the feeding roller is rotated in the anti-sheet feeding direction. In this case, the locking member may comprise a pulled-out portion of the spring member at an end thereof.

A sheet feeding apparatus according to an embodiment of the present invention further comprises a lever so attached to the support shaft as to be able to rock, and a preliminary feeding roller disposed at the rocking end of the lever for feeding a sheet to the feeding roller. When the rotation of the support shaft is transmitted to the locking member through the one-way clutch, the locking member is engaged with the lever, causing the same to rock, thereby to raise the preliminary feedingroller.

According to the arrangement above-mentioned, the single one-way clutch can not only raise the preliminary feeding roller such that a sheet can be inserted, but also lock the stopper to prevent a sheet from being inserted directly into the feeding roller.

The sheet fed by the feeding roller may be a document of for which an image is to be read.

The sheet fed by the feeding roller may be a paper sheet on which an image is to be transferred.

A sheet feeding apparatus according to another embodiment of the present invention comprises: a feeding roller for feeding a sheet; a drive motor capable of rotationally driving the feeding roller in the sheet feeding direction and in the anti-sheet feeding direction; a lever so attached to a support shaft of the feeding roller as to be able to rock, the lever having a rocking end to be raised when the feeding roller is rotated in the anti-sheet feeding direction; and an electric current source for supplying an electric current to the drive motor. The electric current source supplies, to the drive motor, such an electric current that the drive motor is pulled out of synchronism when the load torque of the drive motor has reached a predetermined torque.

If the drive-motor control system fails such that the lever, the roller attached thereto or the like comes in contact with, for example, a cover member which covers the vicinity of the rocking end of the lever, the load torque of the feeding roller reaches a predetermined torque. Accordingly, the drive motor is pulled out of synchronism and runs idle, thus preventing the cover or the like from being damaged. For example, a pulse motor may be used as the drive motor. A pulse motor can accurately be rotated by a predetermined amount according to the supplied pulses. This eliminates the need for a complicated control circuit or the like required for feedback control. This advantageously simplifies the apparatus in arrangement.

A preliminary feeding roller for feeding a sheet to the feeding roller may be attached to the rocking end of the lever.

The predetermined torque may be set to a value less than the value which gives damages to a cover member covering the feeding roller when the lever is raised to raise the feeding roller and the feeding roller comes in contact with the cover member.

A sheet feeding apparatus according to a further embodiment of the present invention further comprises pulling-out-of-synchronism judging means for judging whether or not the drive motor has been pulled out of synchronism, and control means for stopping the electrical supply to the drive motor from the electric current source when the pulling-out-of-synchronism judging means judges that the drive motor has been pulled out of synchronism.

These and other features, objects and advantages of the present invention will be more fully apparent from the following detailed description set forth below when taken in conjunction with the accompanying drawings.

DESCRIPTION OF PREFERRED EMBODIMENTS

Figure 1:
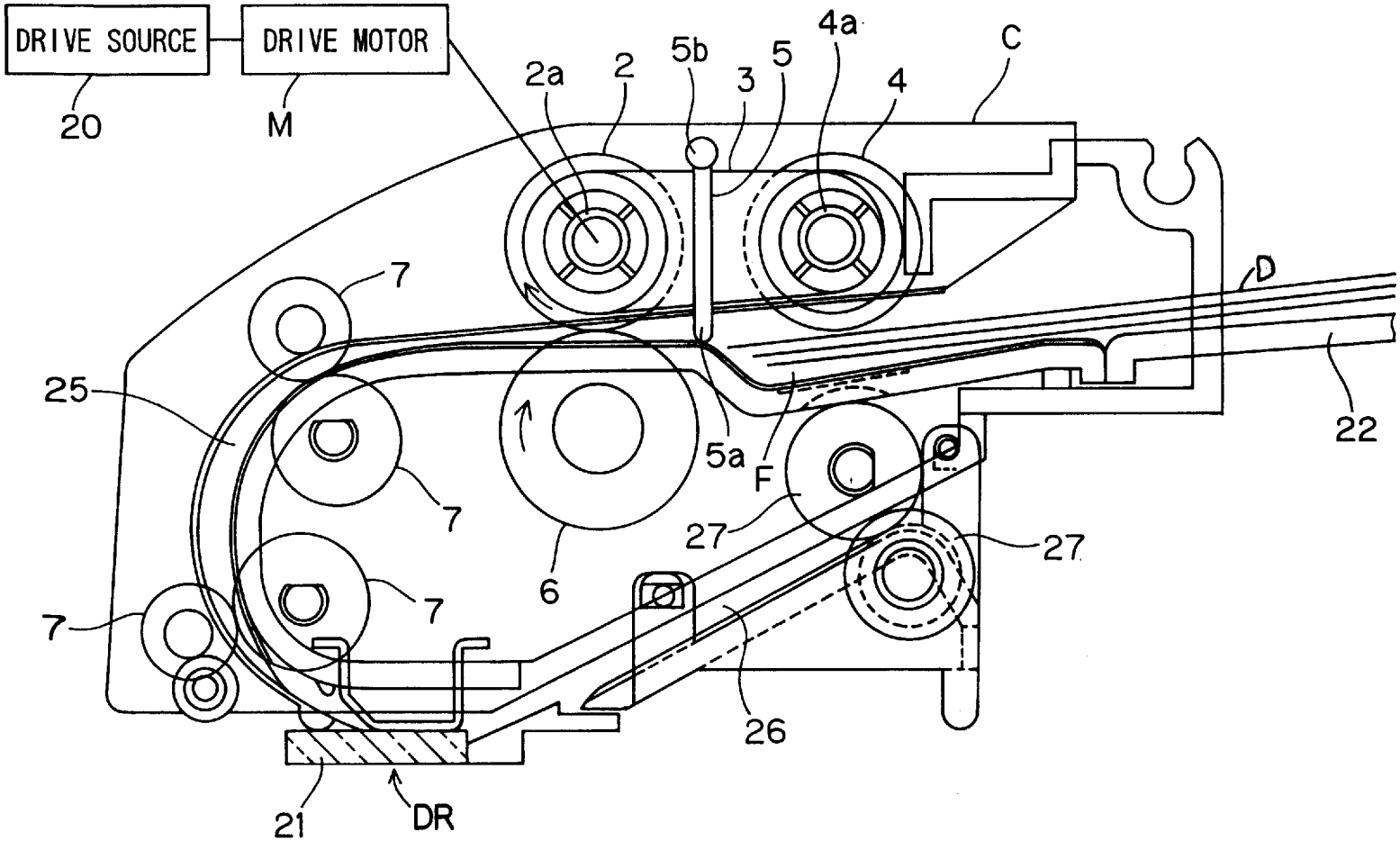
FIG. 1 is a section view illustrating the arrangement of a sheet feeding apparatus according to an embodiment of the present invention.

FIG. 1 is a section view illustrating the arrangement of a sheet feeding apparatus according to an embodiment of the present invention. For example, this sheet feeding apparatus is used as mounted on a transparent plate 21 disposed on an image reading unit DR of a digital copying machine. The image reading unit DR has a reading optical system secured under the transparent plate 21. This reading optical system reads the image of a document transferred on the transparent plate 21.

The sheet feeding apparatus comprises a cover C which covers the apparatus in its entirety, a feeding roller 2 for feeding each document D as a sheet, a preliminary feeding roller 4 for feeding a document D to the feeding roller 2 from a document placing stand 22 on which a plurality of documents D can be placed in lamination, a drive motor M such as a pulse motor or the like for forwardly and reversely rotatably driving the feeding roller 2 and a drive source 20 for controlling the drive motor M and supplying an electric current thereto.

The feeding roller 2 has an integrally rotatable support shaft 2*a* to which a lever 3 is attached such that it can rock along a perpendicular plane. The preliminary feeding roller 4 is rotatably attached to the rocking end of the lever 3. When the support shaft 2*a* is rotated by the drive motor M in the direction opposite to the direction in which the support shaft 2*a* is rotated for transferring a document D (clockwise in FIG. 1), the lever 3 is rotated counterclockwise in FIG. 1 to raise the preliminary feeding roller 4.

Disposed opposite to the feeding roller 2 is a separation roller 6 to which torque is given such that the separation roller 6 is rotated to convey a document D in the direction opposite to the direction in which the feeding roller 2 is rotated to feed a document D. In a curved document transfer passage 25 extending from the separation roller 6 to the transparent plate 21, there are disposed two pairs of transfer rollers 7 for transferring a document D to the transparent plate 21. The document having passed on the transparent plate 21 is discharged to a discharge tray (not shown) from document discharge rollers 27 through a document discharge passage 26.

If a plurality of documents D are simultaneously sent from the preliminary feeding roller 4, the separation roller 6 pushes the lowermost document back and separates the uppermost document from other documents in association with the feeding roller 2.

Upstream of the feeding roller 2 in the document feeding direction (leftwards in FIG. 1), there is disposed, between the feeding roller 2 and the preliminary feeding roller 4, a document stopper 5 for temporarily intercepting the transfer of a document D toward the feeding roller 2. The document stopper 5 is so disposed as to be able to rock around a support 5*b*, and is arranged to temporarily intercept the transfer of a document D to the feeding roller 2.

Figure 2:
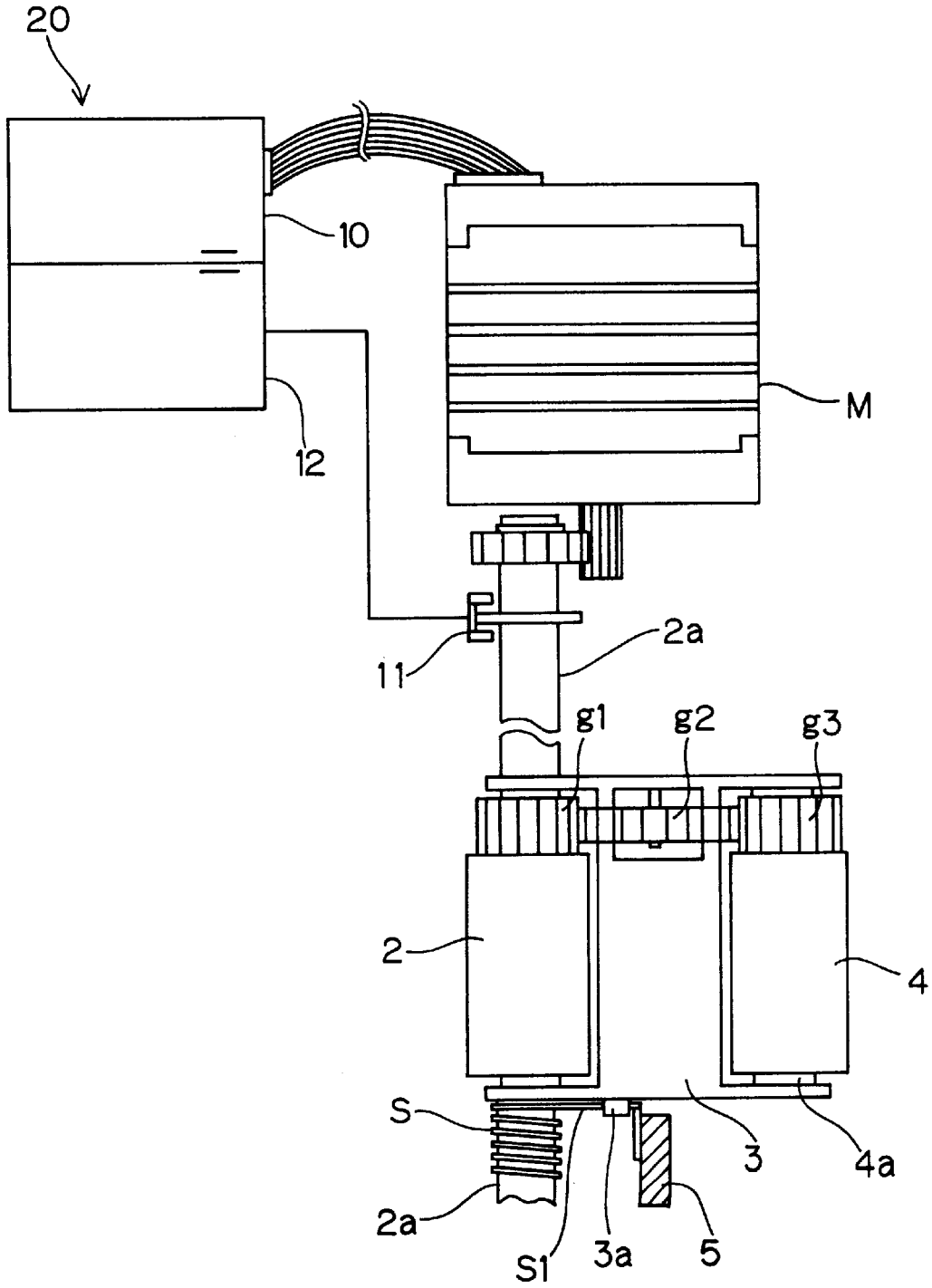
FIG. 2 is a plan view illustrating the arrangement in connection with the preliminary feeding roller and the feeding roller of the sheet feeding apparatus in FIG. 1.
Figure 3:
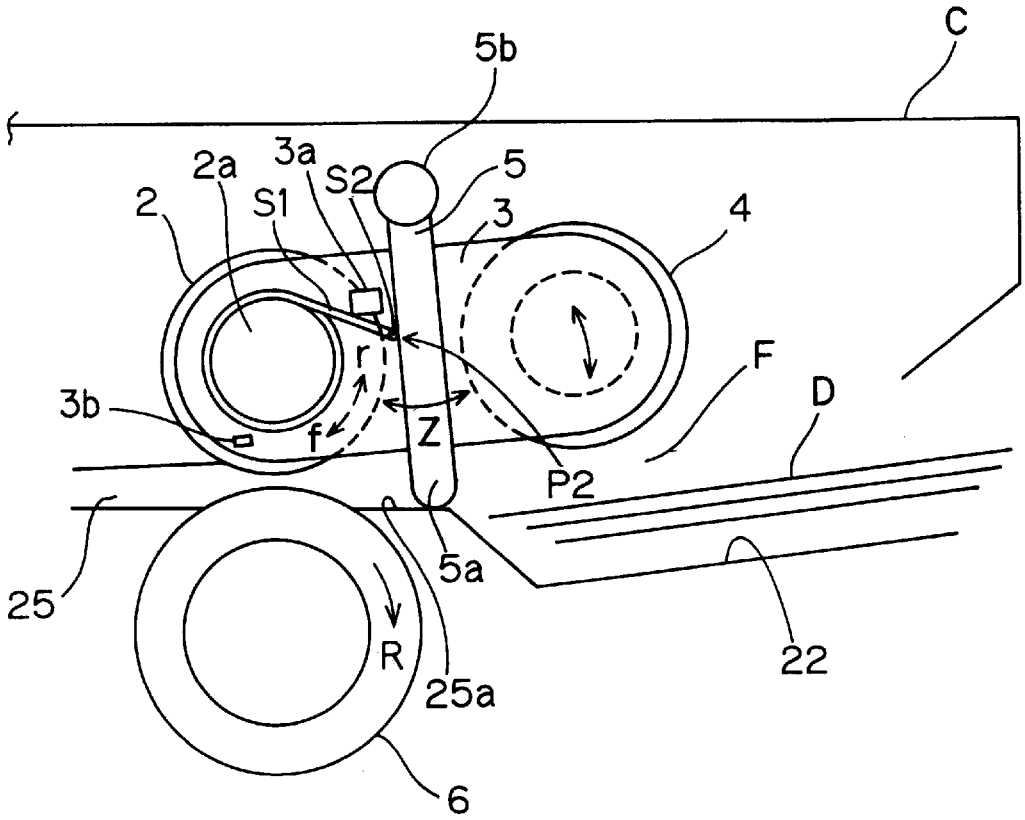
FIG. 3 is a section view illustrating the arrangement in connection with the preliminary feeding roller and the feeding roller in FIG. 2.

FIG. 2 is a plan view illustrating the arrangement in connection with the preliminary feeding roller 4 and the feeding roller 2, and FIG. 3 is an enlarged section view in front elevation illustrating the arrangement in the vicinity of the preliminary feeding roller 4 and the feeding roller 2. A gear g1 is secured to one end of the support shaft 2*a* rotatable integrally with the feeding roller 2. The gear g1 is meshed with an intermediate gear g2 rotatably attached to the lever 3. The intermediate gear g2 is meshed with a gear g3 secured to one end of a support shaft 4*a* of the preliminary feeding roller 4. Accordingly, when the drive motor M gives a drive force to the feeding roller 2, causing the same to be rotated, the preliminary feeding roller 4 is also rotated in the direction identical with the rotational direction of the feeding roller 2.

A spring member S is put on the support shaft 2*a*. The spring member S is wound such that the spring member S is loosened with respect to the support shaft 2*a* when the support shaft 2*a* is rotated in the document feeding direction (clockwise in FIG. 3), and that the spring member S is fastened with respect to the support shaft 2*a* when the support shaft 2*a* is rotated in the anti-document feeding direction (counterclockwise in FIG. 3). One end of the spring member S is pulled out to form a pulled-out portion S1 such that the pulled-out portion S1 comes in contact with an engagement portion 3*a* (interference portion) projecting from the lever 3. When the support shaft 2*a* is rotated to a first predetermined position in the anti-feeding direction, the spring member S is rotated to a second predetermined position together with the support shaft 2*a*. In the course of this rotation, the pulled-out portion S1 of the spring member S comes in contact with the engagement portion 3*a* of the lever 3, causing the same to be rotated. This raises the preliminary feeding roller 4. At this time, the tip S2 of the pulled-out portion S1 comes in contact with the stopper 5 from the downstream side in the document feeding direction. This regulates the rocking of the stopper 5 in the document feeding direction.

As discussed in the foregoing, while the support shaft 2*a* is rotated in the document feeding direction of the feeding roller 2, the spring member S is loosened with respect to the support shaft 2*a* and separated from the stopper 5, allowing the same to freely rock. On the other hand, when the support shaft 2*a* is rotated to the first predetermined position in the anti-feeding direction, the spring member S is rotated together with the support shaft 2*a* to the second predetermined position. The spring member S comes in contact with the stopper 5 to regulate the rocking thereof. Thus, the spring member S serves as a one-way clutch with respect to the rotation of the lever 3, and also serves as locking and locked-state releasing means with respect to the document stopper 5.

The drive motor M stops when the preliminary feeding roller 4 is raised to the position in FIG. 3. The drive motor M is given a rated electric current by the drive source 20 and supplies torque sufficient to raise the lever 3 and the preliminary feeding roller 4.

Before a document D is placed, the support shaft 2*a* is being rotated to the first predetermined position in an r-arrow direction such that the preliminary feeding roller 4 is located in a raised position to open a feeding port F. At this time, the spring member S is being rotated together with the support shaft 2*a* to a second predetermined position P2 shown in FIG. 3. Accordingly, the pulled-out portion S1 of the spring member S comes in contact with the engagement portion 3*a* to raise the lever 3.

The tip S2 of the pulled-out portion S1 comes in contact with the stopper 5 to lock the rocking thereof in a Z direction in FIG. 3, thus intercepting the transfer of a document D to the feeding roller 2. The stopper 5 is locked into the interception state and the document D cannot be inserted into the position of the feeding roller 2. The document transfer passage is intercepted by the stopper 5 for the following reason. When documents D are supplied to the feeding roller 2 with force exerted in the document feeding direction, the documents D cannot properly be separated from one another by the separation roller 6. This involves the likelihood that the feeding roller 2 feeds a plurality of documents D simultaneously.

When a copy start button is pushed with the document insertion in the sheet feeding port F detected by an optical sensor (not shown), the feeding roller 2 is rotated in the document feeding direction (in an f-arrow direction). At this time, clamping of the support shaft 2*a* by the spring member S is loosened and, with the rotation of the support shaft 2*a*, the pulled-out portion S1 is moved to the position where the pulled-out portion S1 comes in contact with a stop piece 3*b* disposed on the lever 3. This releases the locked state of the stopper 5, enabling the same to rock. Further, the preliminary feeding roller 4 is lowered due to its own weight while rotated in a direction identical with the rotation direction of the feeding roller 2.

When the preliminary feeding roller 4 comes in contact with a document D and starts transferring the same, the tip of the document D comes in contact with the stopper 5, causing the same to rock in the document feeding direction. This forms a gap between the stopper 5 and the lower surface 25*a* of the document transfer passage 25. Through this gap, one or more documents D are guided to the feeding roller 2.

When documents D sent by the preliminary feeding roller 4 reach the vicinity of the feeding roller 2, only the uppermost document D is fed downstream by the feeding roller 2. More specifically, in document transfer, the separation roller 6 is rotated in an R-arrow direction identical with the document feeding direction of the feeding roller 2. When two or more documents D are simultaneously fed to the separation roller 6, other documents D than the uppermost document D receive force against the feeding force exerted by the preliminary feeding roller 4, thus preventing these documents D from entering into between the feeding roller 2 and the separation roller 6.

The document D fed by the feeding roller 2 is transferred to the transparent plate 21 by the transfer rollers 7.

As discussed in the foregoing, the sheet feeding apparatus can automatically smoothly feed a plurality of documents one by one successively to the transparent plate 21.

According to this embodiment, the spring member S as an example of a mechanical one-way clutch is operated not only to intercept the document transfer passage by the stopper 5 but also to release such intercept. This eliminates the need for locked-state releasing means such as a solenoid or the like and an electric system therefor which have been used for releasing the intercept state provided by the stopper in a conventional apparatus. Thus, the sheet feeding apparatus can be simplified in arrangement and reduced in the number of component elements thereof. The spring member S serves as drive means for raising and lowering the preliminary feeding roller 4 and also serves as stopper locking/locked-state releasing means, thus remarkably contributing to the reduction in the number of component elements.

As shown in FIG. 2, the drive source 20 for driving and controlling the drive motor M includes: an electric current source 10 for supplying, to the drive motor M, such an electric current that the drive motor M is pulled out of synchronism when the load torque of the drive motor M has reached predetermined torque; a detector 11 for detecting the rotational speed of the support shaft 2*a* which supports the feeding roller 2; and control means 12 for judging, based on the rotational speed of the support shaft 2*a* detected by the detector 11, the pulling-out of synchronism of the drive motor M to stop the electrical supply thereto.

As mentioned earlier, in order that the preliminary feeding roller 4 does not obstruct the feeding port F before a document is set, the support shaft 2*a* is rotated in the direction opposite to the document feeding direction by the drive motor M such that the preliminary feeding roller 4 and the lever 3 are raised to predetermined positions. When the preliminary feeding roller 4 and the lever 3 are raised to the predetermined positions, the control means 12 stops the electrical supply from the electric current source 10 to stop the drive motor M. According to this embodiment, a pulse motor is used as the drive motor M. A pulse motor is controlled by a pulse train supplied from a control system and can advantageously conduct both accurate positioning and speed control without use of feedback control.

An electric current to be supplied to the drive motor M from the electric current source 10 is determined in the following manner. There is previously measured the load torque of the drive motor M obtained at the time when the drive motor M is intentionally not stopped, causing the preliminary feeding roller 4 to come in contact with the cover C to damage the same. The electric current to be supplied to the drive motor M is set such that the maximum output torque of the drive motor M does not exceed the torque thus measured.

If the electrical supply to the drive motor M from the electric current source 10 is not stopped for some reason when the drive motor M is driven for raising the lever 3 to a predetermined height, the tip S2 of the spring member S is continuously raised to further raise the lever 3, causing the preliminary feeding roller 4 to come in contact with the cover C which covers the apparatus in its entirety.

At this time, the preliminary feeding roller 4 tends to continue to forcefully rotate. Likewise in apparatus of the prior art, if the preliminary feeding roller 4 continued to rotate when the load torque of the drive motor M became great, a load would be exerted to the cover C and the spring member S, involving the likelihood that these component elements would be ultimately damaged. In the sheet feeding apparatus of this embodiment, on the other hand, even though the preliminary feeding roller 4 tends to continue to forcefully rotate, the drive motor M is pulled out of synchronism when the torque of the drive motor M reaches the previously measured torque, e.g., 0.003 N.m. More specifically, when the torque of the drive motor M reaches the previously measured torque, the drive motor M and the support shaft 2*a* are no longer in synchronism with each other in rotation such that the torque given to the lever 3 is remarkably reduced until such pulling-out-of-synchronism is cancelled. Thus, there is no possibility of a great load being exerted to the cover C and the spring member S, thereby eliminating the likelihood for a component element to be damaged.

In the sheet feeding apparatus of this embodiment, the rotational speed of the support shaft 2*a* is always monitored by the detector 11 such as a rotary encoder or the like. The control means 12 is arranged to compare the set speed obtained based on the pulse period given to the pulse motor above-mentioned, with the rotational speed of the feeding roller 2 detected by the detector 11. When the rotational speed of the support shaft 2*a* becomes remarkably smaller than the set speed of the pulse motor even though the pulse motor has once reached a steady operation state, it is judged that the pulse motor has been pulled out of synchronism. After the passage of a predetermined period of time from the judgment, the electrical supply to the pulse motor or drive motor M from the electric current source 10 is stopped.

Thus, the sheet feeding apparatus of this embodiment has the electric current source 10 for supplying, to the drive motor M, such an electric current that the drive motor M is pulled out of synchronism when the load torque of the drive motor M reaches the predetermined torque. Accordingly, even though an unforeseen accident occurs and the electrical supply to the drive motor M is not stopped, causing the preliminary feeding roller 4 to come in contact with the cover C, the drive motor M is pulled out of synchronism to stop the rotation of the preliminary feeding roller 4 before a component element such as the cover C or the like is damaged.

An embodiment of the present invention has been discussed, but the present invention may be embodied in any of different modes.

For example, a pulse motor simple in control is used as the drive motor M in the embodiment above-mentioned, but a small-size motor such as a DC motor or the like may also be used. A sheet feeding apparatus using such a small-size motor is also included in the present invention.

The embodiment above-mentioned is arranged such that the electrical supply from the electric current source 10 is stopped after the passage of a predetermined period of time from the judgment by the control means 12 that the drive motor M has been pulled out of synchronism. Instead, the apparatus may have alarm sound producing means for producing a predetermined alarm sound, or alarm character display means for displaying predetermined alarm characters, and may be arranged such that after the passage of a predetermined period of time, the failure is informed to the user by the alarm sound or characters. It is a matter of course that the alarm sound producing means, the alarm character display means and the control means 12 of this embodiment may be combined. A sheet feeding apparatus having any of such arrangements is also included in the present invention.

Figure 4:
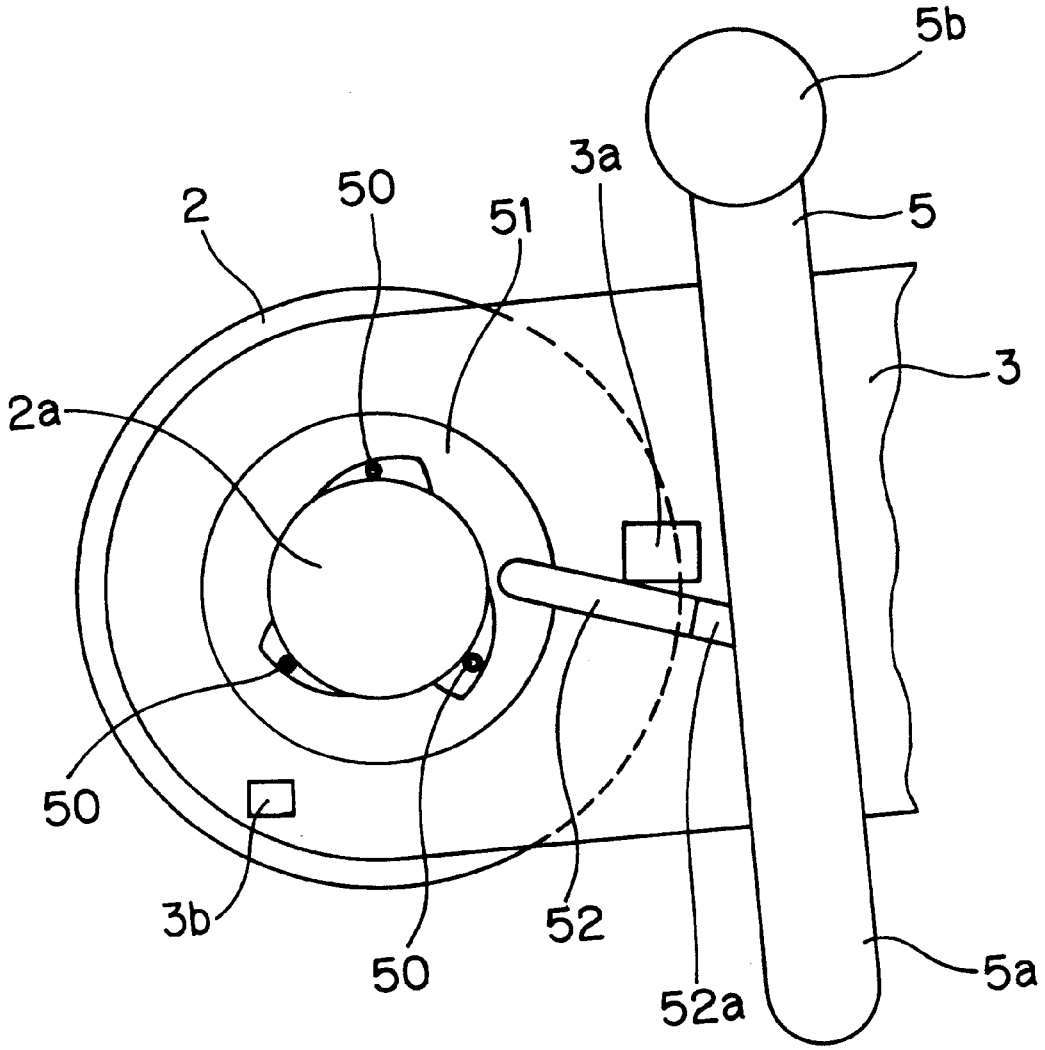
FIG. 4 is a schematic view illustrating an example of a locking mechanism for the document stopper of the sheet feeding apparatus in FIG. 1.
Figure 5:
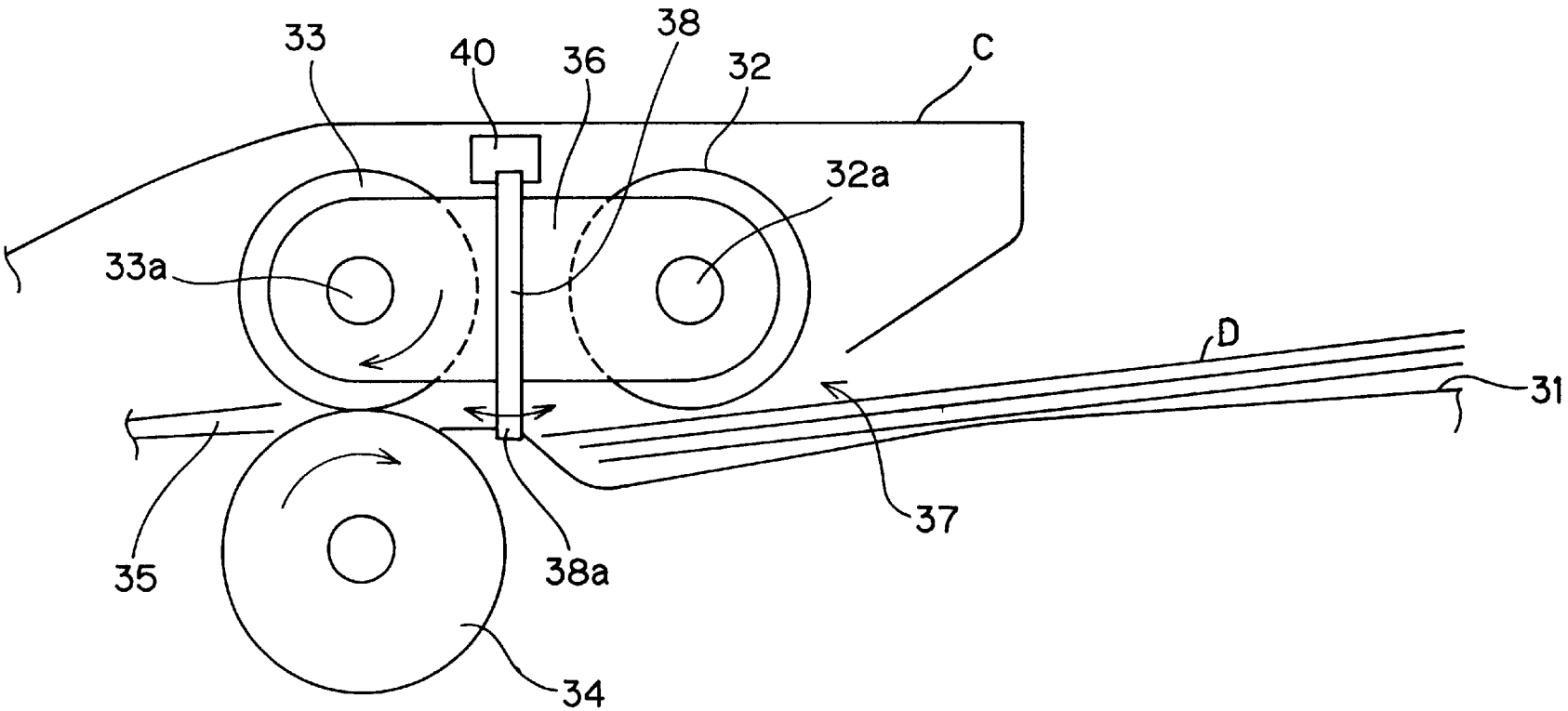
FIG. 5 is a simplified section view illustrating the arrangement of a sheet feeding apparatus of the prior art.

In the embodiment above-mentioned, the spring member S forms a one-way clutch. As shown in FIG. 4, however, there may be used a general one-way clutch 51 arranged such that balls 50 are fastened with respect to the support shaft 2*a* while the support shaft 2*a* is rotated in the direction opposite to the document feeding direction and that the balls 50 are loosened with respect to the support shaft 2*a* while the support shaft 2*a* is rotated in the document feeding direction. In this case, the one-way clutch 51 preferably has a locking member 52 which can come in contact with the engagement portion 3*a* of the lever 3 and of which tip 52*a* comes in contact with the stopper 5. Such a sheet stopper drive device is also included as an example of the sheet stopper drive device in the present invention.

In the embodiment above-mentioned, the sheet stopper drive device is used in the sheet feeding apparatus for feeding each document D to the transparent plate 21. However, the sheet stopper drive device may also be used in a both-side copying machine or the like to drive a sheet stopper which regulates an image transfer sheet to be fed to the transparent plate from an intermediate tray. Such a sheet stopper drive device is also included as an example of the sheet stopper drive device in the present invention.

To further reduce the number of component elements, the sheet stopper drive device in the embodiment above-mentioned is arranged such that the spring member S for raising the preliminary feeding roller 4 also serves as a one-way clutch. However, another spring member or means such as the one-way clutch 52 may additionally be used for such a one-way clutch. Such an apparatus is also included as an example of the sheet stopper drive device in the present invention.

An embodiment of the present invention has been discussed in detail. However, this embodiment is merely a specific example for clarifying the technical contents of the present invention and the present invention is not to be construed in a restricted sense as limited to this specific example. Thus, the spirit and scope of the present invention are limited only by the appended claims.

This application claims priority benefits under 35 USC §119 of Japanese Patent Application Serial Nos. 8-304640 and 8-304642 filed in the Japanese Patent Office on Nov. 15, 1996, the disclosure of which is incorporated herein by reference.

What is claimed is:

1. A sheet feeding apparatus, comprising:

a feeding roller for feeding a sheet;

a support shaft forwardly and reversely rotatable integrally with the feeding roller;

a stopper disposed upstream of the feeding roller in a sheet feeding direction for temporarily regulating the feed of a sheet to the feeding roller;

a locking member for locking the stopper into a regulating position where the feed of a sheet is regulated, and for releasing this locked state; and a one-way clutch attached to the support shaft for transmitting a rotation in one direction of the feeding roller to the locking member, causing the locking member to lock the stopper.

2. A sheet feeding apparatus according to claim 1, wherein the one-way clutch is loosened with respect to the support shaft while the feeding roller is rotated in the sheet feeding direction, and transmits the rotation of the support shaft to the locking member while the feeding roller is rotated in an anti-sheet feeding direction.

3. A sheet feeding apparatus according to claim 2, wherein, when the support shaft of the feeding roller is rotated to a first predetermined position in the anti-sheet feeding direction, the locking member is rotated, by the one-way clutch, to a second predetermined position where the locking member comes in contact with the stopper.

4. A sheet feeding apparatus according to claim 1, wherein the stopper is disposed so as to be able to rock, and the locking member is arranged not only to lock the stopper into the regulating position to regulate the rocking of the stopper, but also to release the locked state of the stopper, thus allowing the stopper to rock.

5. A sheet feeding apparatus according to claim 1, wherein the one-way clutch includes a spring member wound on the support shaft such that the spring member is loosened with respect to the support shaft while the feeding roller is rotated in the sheet feeding direction, and that the spring member is fastened with respect to the support shaft while the feeding roller is rotated in an anti-sheet feeding direction.

6. A sheet feeding apparatus according to claim 5, wherein the locking member includes a pulled-out portion of the spring member at an end thereof.

7. A sheet feeding apparatus according to claim 1, further comprising a lever attached to the support shaft so as to be able to rock, and a preliminary feeding roller disposed at a rocking end of the lever for feeding a sheet to the feeding roller, and wherein the rotation of the support shaft is transmitted to the locking member through the one-way clutch such that the locking member is engaged with the lever, causing the lever to rock, thereby to raise the preliminary feeding roller.

8. A sheet feeding apparatus according to claim 1, wherein the sheet fed by the feeding roller is a document for which an image is to be read.

9. A sheet feeding apparatus according to claim 1, wherein the sheet fed by the feeding roller is a sheet on which an image is to be transferred.

* * * * *